US005881959A

United States Patent [19]

Hadjinian et al.

[11] Patent Number: 5,881,959

[45] Date of Patent: Mar. 16, 1999

[54] MATERIALS GRINDER WITH INFEED CONVEYOR AND ANVIL

[75] Inventors: Michael C. Hadjinian, New Berlin; George T. Moeller, Oconomowoc; Sudhakar S. Kolli, West Milwaukee; Jerome Gallo, New Berlin, all of Wis.

[73] Assignee: CMI Corporation, Oklahoma City, Okla.

[21] Appl. No.: 584,136

[22] Filed: Jan. 11, 1996

Related U.S. Application Data

[63] Continuation-in-part of Ser. No. 434,929, May 4, 1995, abandoned.

[51] Int. Cl.[6] ..... B02C 13/02; B02C 13/286

[52] U.S. Cl. ..... 241/34; 241/186.35; 241/222; 241/223; 241/289

[58] Field of Search ..... 241/34, 222, 223, 241/289, 186.35, 287, 288

[56] References Cited

U.S. PATENT DOCUMENTS

| | | |
|---|---|---|
| 25,254 | 8/1859 | Gilmore . |
| 48,813 | 7/1865 | Hodge . |
| 113,283 | 4/1871 | Farrar . |
| 328,996 | 10/1885 | Anthoine . |
| 349,607 | 9/1886 | Reeder . |

(List continued on next page.)

FOREIGN PATENT DOCUMENTS

| | | |
|---|---|---|
| A2 0080621 | 11/1982 | European Pat. Off. . |
| A3 0103778 | 8/1983 | European Pat. Off. . |
| 182749 | 11/1985 | European Pat. Off. . |
| 2527477 | 5/1982 | France . |
| 3517579 A1 | 5/1985 | Germany . |

(List continued on next page.)

OTHER PUBLICATIONS

Olathe Model 818TG Wood & Organic Tub Grinder (Brochure) (No date given).

Olathe Model 837TG Tub Grinder (Brochure) (No date given).

Willibald, WSC–2000, Willibald–Super–Cut (Brochure) (No date given).

Rexworks, Maxigrind 350/425 (Brochure) (No date given).

Willibald, MZA 2500, Mobile Organic Resource Processor (Brochure) (No date given).

(List continued on next page.)

*Primary Examiner*—John M. Husar

*Attorney, Agent, or Firm*—Reinhart, Boerner, Van Deuren, Norris & Rieselbach, s.c.

[57] ABSTRACT

A materials grinder includes a rotary grinding drum and a shear bar cooperating with the grinding drum to grind various types of materials. The shear bar is mounted on a pivotal structure adjacent the materials grinding drum. A displaceable biasing member biases the pivotal structure toward the grinding drum to maintain the shear bars in close cooperating relationship therewith. If ungrindable materials are encountered, the pivotal structure pivots away from the grinding drum against the bias force of the biasing member to permit the ungrindable materials to pass between the grinding drum and the shear bar. Once the ungrindable materials pass, the biasing member moves the pivotal structure back toward the grinding drum. Materials to be ground are fed to the grinding drum by means of an infeed conveyor and an overhead infeed roller. The infeed conveyor and roller are coupled to one or more overload sensors that can reverse the infeed conveyor and roller for a predetermined period of time if material jams the grinding drum or feed mechanisms. The infeed conveyor and roller enable the materials grinder to effectively process springy materials such a brush, live branches and other green waste. The materials grinder is thus well-suited to grind both green waste and more rigid materials that might contain ungrindable components.

19 Claims, 8 Drawing Sheets

U.S. PATENT DOCUMENTS

| | | |
|---|---|---|
| 448,884 | 3/1891 | Merrell . |
| 764,268 | 7/1904 | Boileau . |
| 773,479 | 10/1904 | Cornell . |
| 984,758 | 2/1911 | Gardner . |
| 989,498 | 4/1911 | Gallaher . |
| 1,030,919 | 7/1912 | Priem . |
| 1,119,353 | 12/1914 | Jackson . |
| 1,185,620 | 6/1916 | Blum . |
| 1,258,370 | 3/1918 | Sooter . |
| 1,348,659 | 8/1920 | Nicholson et al. . |
| 1,352,609 | 9/1920 | Kendall . |
| 1,420,877 | 6/1922 | Sommers et al. . |
| 1,523,614 | 1/1925 | Shelton . |
| 1,626,015 | 4/1927 | Ullgren . |
| 1,634,026 | 6/1927 | Fritz . |
| 1,691,196 | 11/1928 | Jirotka . |
| 1,735,824 | 11/1929 | Huffman . |
| 1,757,031 | 5/1930 | Whitcomb . |
| 1,783,373 | 12/1930 | Borton . |
| 2,045,691 | 6/1936 | Armstrong . |
| 2,063,829 | 12/1936 | Riley . |
| 2,150,278 | 3/1939 | Hegenbarth . |
| 2,287,799 | 6/1942 | Hartshorn . |
| 2,440,927 | 5/1948 | Boss et al. . |
| 2,548,425 | 4/1951 | Dodge . |
| 2,612,974 | 10/1952 | Krause . |
| 2,665,851 | 1/1954 | Strehlow . |
| 2,797,052 | 6/1957 | Clark . |
| 2,828,922 | 4/1958 | Knight . |
| 2,877,956 | 3/1959 | Sackett . |
| 2,905,456 | 9/1959 | Rafferty et al. . |
| 2,962,234 | 11/1960 | Avila . |
| 2,986,347 | 5/1961 | Stevenson . |
| 3,098,614 | 7/1963 | Meyer . |
| 3,117,735 | 1/1964 | Fourey . |
| 3,128,953 | 4/1964 | Wageneder . |
| 3,160,351 | 12/1964 | Shelton, Jr. . |
| 3,194,288 | 7/1965 | Dodgen et al. . |
| 3,327,572 | 6/1967 | Lovendahl . |
| 3,343,800 | 9/1967 | Rasmussen . |
| 3,458,143 | 7/1969 | Hofmann . |
| 3,473,742 | 10/1969 | Montgomery . |
| 3,480,214 | 11/1969 | Wageneder . |
| 3,528,618 | 9/1970 | Ullner . |
| 3,531,055 | 9/1970 | Alt . |
| 3,545,690 | 12/1970 | Burian . |
| 3,559,898 | 2/1971 | Rinke . |
| 3,587,983 | 6/1971 | Heinrich . |
| 3,596,841 | 8/1971 | Perry . |
| 3,602,444 | 8/1971 | Meyer . |
| 3,608,841 | 9/1971 | Wageneder . |
| 3,612,413 | 10/1971 | Perry . |
| 3,630,458 | 12/1971 | Smiley . |
| 3,643,873 | 2/1972 | George . |
| 3,659,792 | 5/1972 | Von Conrad et al. . |
| 3,659,794 | 5/1972 | Hemesath . |
| 3,690,568 | 9/1972 | Alexander . |
| 3,690,572 | 9/1972 | Thumm et al. . |
| 3,693,891 | 9/1972 | Remmer . |
| 3,701,483 | 10/1972 | Crosby et al. . |
| 3,771,733 | 11/1973 | Hadley et al. . |
| 3,823,633 | 7/1974 | Ross . |
| 3,857,520 | 12/1974 | Ducasse . |
| 3,873,035 | 3/1975 | Benson . |
| 3,929,294 | 12/1975 | Cox . |
| 3,960,334 | 6/1976 | Wudyka . |
| 4,015,783 | 4/1977 | Miller . |
| 4,017,035 | 4/1977 | Stuttmann . |
| 4,049,206 | 9/1977 | Konig et al. . |
| 4,061,277 | 12/1977 | Whitney . |
| 4,082,231 | 4/1978 | Gould . |
| 4,083,502 | 4/1978 | Dittman . |
| 4,098,466 | 7/1978 | MacElvain et al. . |
| 4,101,082 | 7/1978 | Mayer et al. . |
| 4,119,277 | 10/1978 | Snyder et al. ..... 241/167 |
| 4,146,184 | 3/1979 | Whitney . |
| 4,151,959 | 5/1979 | Deister . |
| 4,165,045 | 8/1979 | Hager et al. . |
| 4,175,710 | 11/1979 | Robertson . |
| 4,185,875 | 1/1980 | Swisher, Jr. et al. . |
| 4,193,556 | 3/1980 | Linnertz et al. . |
| 4,202,503 | 5/1980 | Parkinson et al. . |
| 4,211,507 | 7/1980 | Kress et al. . |
| 4,226,375 | 10/1980 | Cameron . |
| 4,294,412 | 10/1981 | Bohlin et al. . |
| 4,456,182 | 6/1984 | Suttinger et al. . |
| 4,515,318 | 5/1985 | Savonjousl . |
| 4,542,856 | 9/1985 | Adolph . |
| 4,545,539 | 10/1985 | Steffensen . |
| 4,595,150 | 6/1986 | Aario . |
| 4,597,538 | 7/1986 | Getz . |
| 4,597,695 | 7/1986 | Johnson . |
| 4,637,753 | 1/1987 | Swisher, Jr. . |
| 4,688,725 | 8/1987 | Blomqvist et al. . |
| 4,694,997 | 9/1987 | Schonbach . |
| 4,706,898 | 11/1987 | Schonfeld et al. . |
| 4,714,374 | 12/1987 | Mihara . |
| 4,730,791 | 3/1988 | Hausler et al. . |
| 4,736,781 | 4/1988 | Morey et al. . |
| 4,813,620 | 3/1989 | Engelmohr et al. . |
| 4,815,667 | 3/1989 | Keller . |
| 4,852,816 | 8/1989 | Doppstadt . |
| 4,871,119 | 10/1989 | Murata et al. . |
| 4,903,903 | 2/1990 | Benen . |
| 4,905,919 | 3/1990 | Okazaki . |
| 4,919,344 | 4/1990 | McKie . |
| 4,927,088 | 5/1990 | Brewer . |
| 4,982,904 | 1/1991 | Greiner . |
| 5,018,674 | 5/1991 | Williams . |
| 5,044,567 | 9/1991 | Hte et al. . |
| 5,071,079 | 12/1991 | Fykse et al. . |
| 5,102,059 | 4/1992 | Nyberg et al. . |
| 5,150,843 | 9/1992 | Miller et al. . |
| 5,150,844 | 9/1992 | McKie . |
| 5,165,611 | 11/1992 | Ragnarsson . |
| 5,205,496 | 4/1993 | O'Donnell et al. ..... 241/34 |
| 5,209,412 | 5/1993 | Dwyer et al. ..... 241/101.7 |
| 5,230,475 | 7/1993 | Gerner ..... 241/34 |
| 5,255,869 | 10/1993 | Smith . |
| 5,344,088 | 9/1994 | Page . |
| 5,645,234 | 7/1997 | Del Zotto ..... 241/101.76 |
| 5,655,719 | 8/1997 | Getz ..... 241/27 |

FOREIGN PATENT DOCUMENTS

| | | |
|---|---|---|
| 36 44 169 A1 | 12/1986 | Germany . |
| 35 43 902 C1 | 5/1987 | Germany . |
| 42130 | 11/1925 | Norway . |
| 48539 | 10/1930 | Norway . |
| 120267 | 6/1926 | Switzerland . |
| 1033062A | 8/1983 | U.S.S.R. . |
| 1238787A | 6/1986 | U.S.S.R. . |
| 658087 | 9/1949 | United Kingdom . |
| 1382561 | 4/1973 | United Kingdom . |
| 1453811 | 1/1975 | United Kingdom . |
| 2189406 | 4/1987 | United Kingdom . |

OTHER PUBLICATIONS

Morbark, Model 1100 Tub Grinder (Brochure) (No date given).

Vermeer, Brawny TG400 Tub Grinder (Brochure) (No date given).

Fuel Harvestors Equipment, Wood Waste Tub Grinder (Brochure) (No date given).
Peterson, HC 4400 (Brochure) (No date given).
Morbark, Model 1400 Tub Grinder (Brochure) (No date given).
Olathe, Model 867TG & Model 867KBL Wood & Organic Debris Tub Grinders (Brochure) (No date given).
Nicholson, Wastepro Portable Hog System (Brocuhre) (No date given).
CBI, Roadmill (Brochure) (No date given).
Rexworks, Maxi–Grind 200 (Brochure) (No date given).
Rexworks, Megagrind (Brochure) (No date given).

MATERIALS GRINDER WITH INFEED CONVEYOR AND ANVIL

This application is a C.I.P. of Ser. No. 08/434,929 filed May 4, 1995, now abandoned.

INVENTION

This invention relates generally to materials grinders and, more particularly, to materials grinders suitable for grinding brush and green waste as well as a wide variety of materials including solid, rigid materials and various building materials.

Materials grinders are often used to grind a variety of materials ranging from railroad ties, tree trunks and broken pavement, to soft springy material, such as brush and live branches. Grinders that are well-suited for grinding one type of material are often inefficient for grinding other types of materials. For example, the materials grinder shown in U.S. Pat. No. 5,344,088, owned by the assignee hereof, is well-suited for grinding solid rigid materials such as railroad ties and broken pavement. However, because the grinder includes a ram that forces the unground materials from a hopper to a rotary grinding drum, the grinder is not perfectly suited to grinding softer, springier materials such as brush, live tree branches and other green waste. As the ram moves, these materials can spring upwardly in the hopper rather than advance toward the grinding drum.

Other known types of grinders include tub grinders wherein materials to be ground are dropped into a circular tub. Still other grinders utilize a conveyor to carry materials to a conventional hammer mill. Although effective in handling certain green waste materials, such grinders are not well-suited to grinding more massive, rigid materials that might contain ungrindable components.

SUMMARY OF THE INVENTION

The invention provides a materials grinder having a rotary grinding drum and a pivotal structure adjacent the rotary grinding drum. One or more shear bars are disposed on the pivotal structure adjacent the rotary grinding drum in cooperating relationship therewith. A displaceable biasing member is provided for biasing the pivotal structure toward the grinding drum while permitting limited displacement of the concave away from the grinding drum to permit ungrindable materials to pass between the grinding drum and the pivotal structure. The materials grinder further includes an infeed conveyor having an upper conveying surface for receiving materials to be ground and for conveying the materials to the rotary grinding drum.

In one embodiment, an infeed roller is provided for drawing materials to be ground in toward the rotary grinding drum.

In another embodiment, the conveyor includes a continuous conveyor belt having an upper run moving toward the grinding drum.

In yet another embodiment, the pivotal structure is biased toward the grinding drum with a hydraulic cylinder.

It is an object of the present invention to provide a new and improved materials grinder.

It is a further object of the present invention to provide a new and improved materials grinder that is effective in grinding springy materials, such as brush, live branches and other green waste, as well as larger, more rigid materials such as railroad ties and various building materials.

It is yet another object of the present invention to provide a new and improved materials grinder that effectively grinds a wide variety of grindable materials while permitting the passage of ungrindable materials without significant wear or damage being caused to the materials grinder.

BRIEF DESCRIPTION OF THE DRAWINGS

The features of the present invention which are believed to be novel are set forth with particularity in the appended claims. The invention, together with the further objects and advantages thereof, may best be understood by reference to the following description taken in conjunction with the accompanying drawings, in which like reference numerals identify like elements, and in which:

DESCRIPTION OF THE PREFERRED EMBODIMENT

Figure 1:
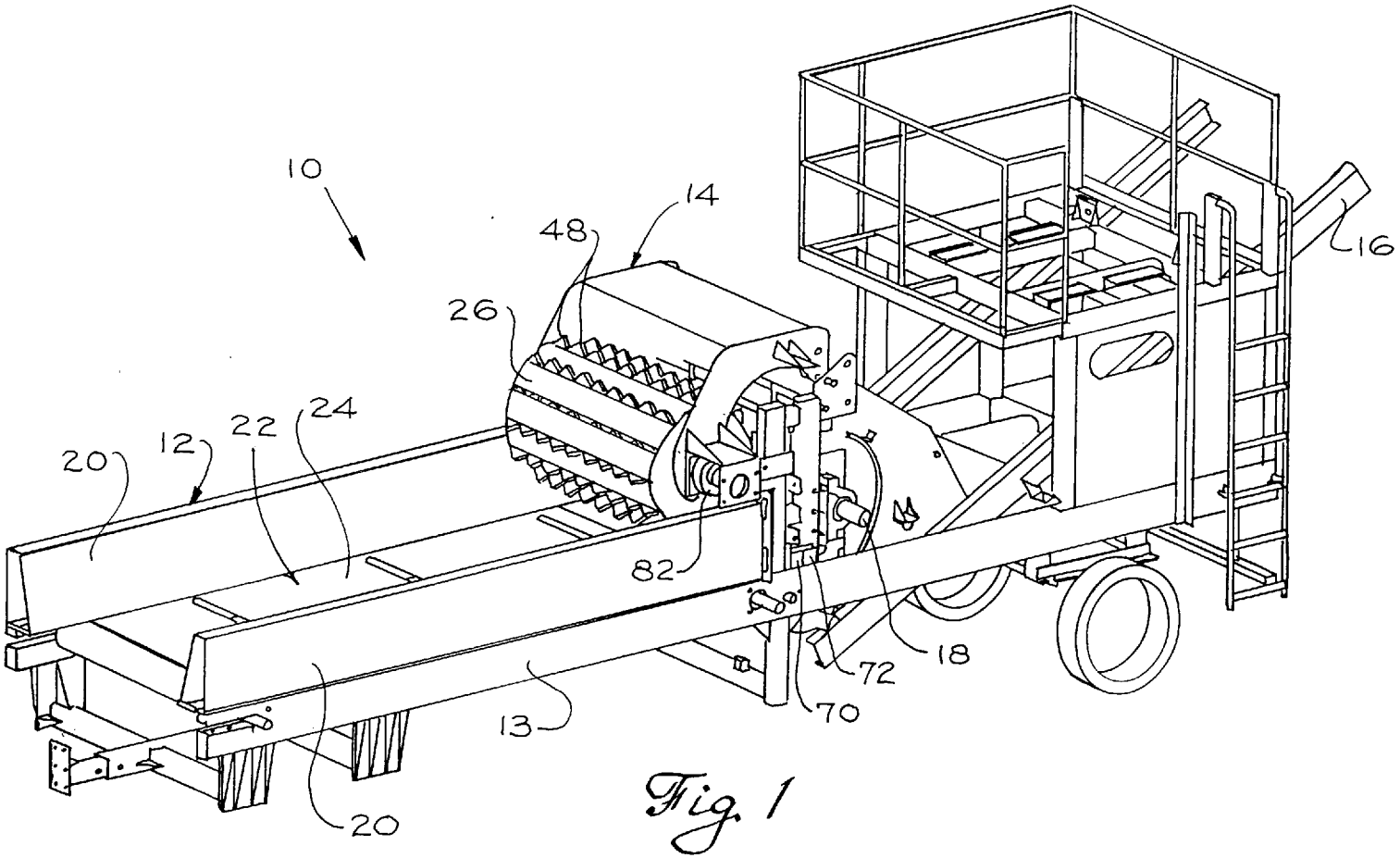
FIG. 1 is a perspective view of a materials grinder embodying various features of the invention.
Figure 2:
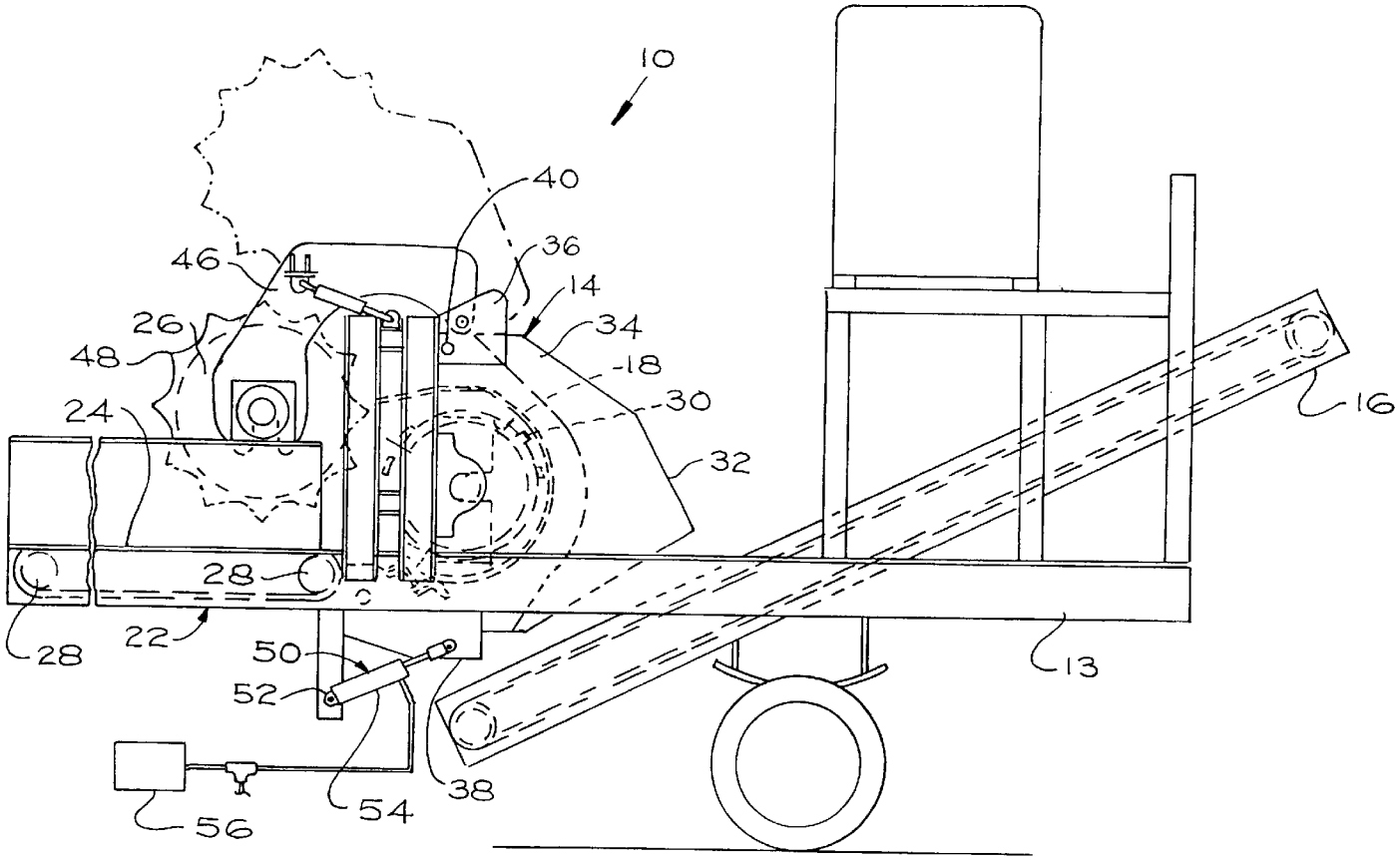
FIG. 2 is a side elevation view of the materials grinder shown in FIG. 1.
Figure 3:
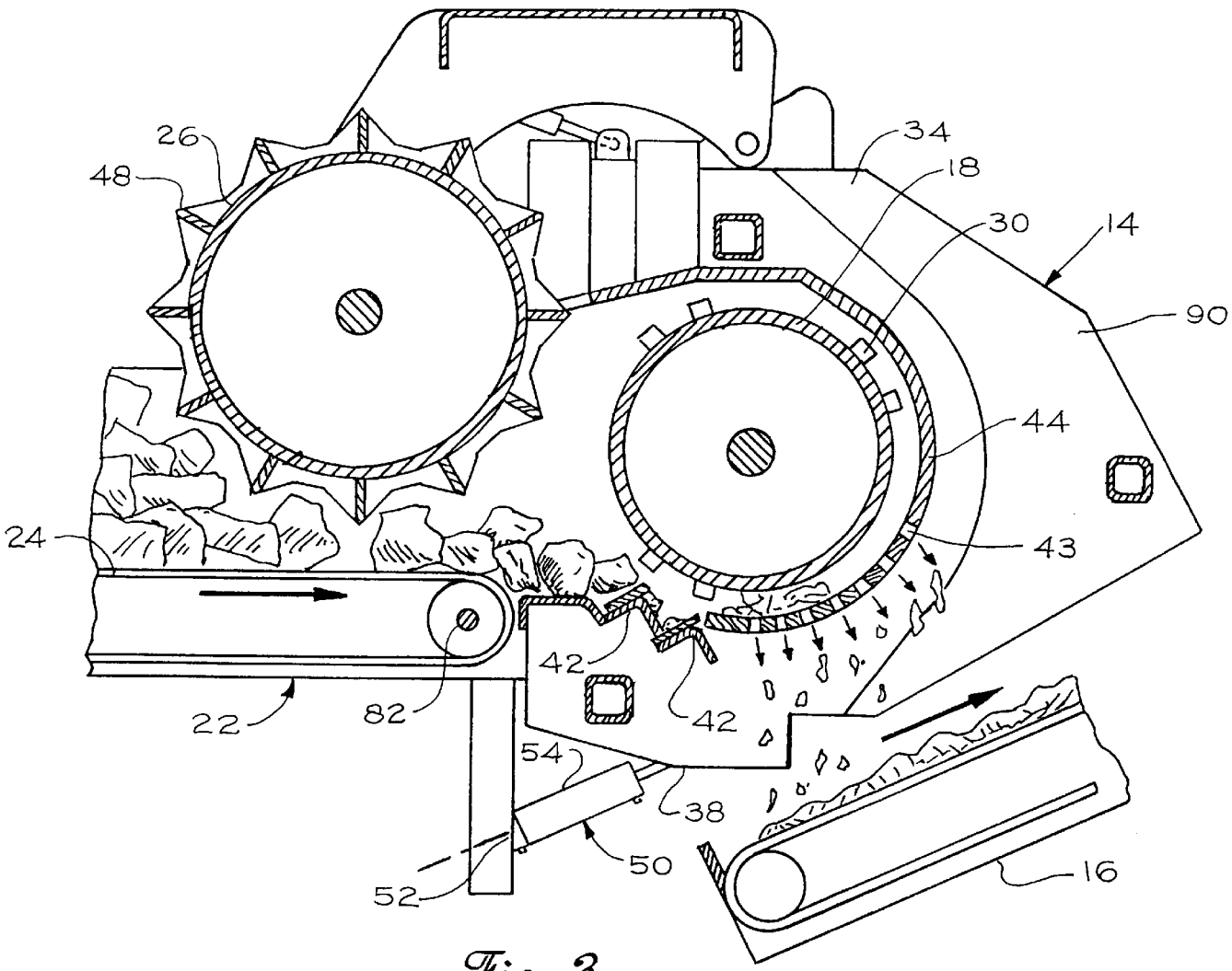
FIG. 3 is a fragmentary side view, partially in section, showing the infeed conveyor and grinding mechanism of the materials grinder.
Figure 4:
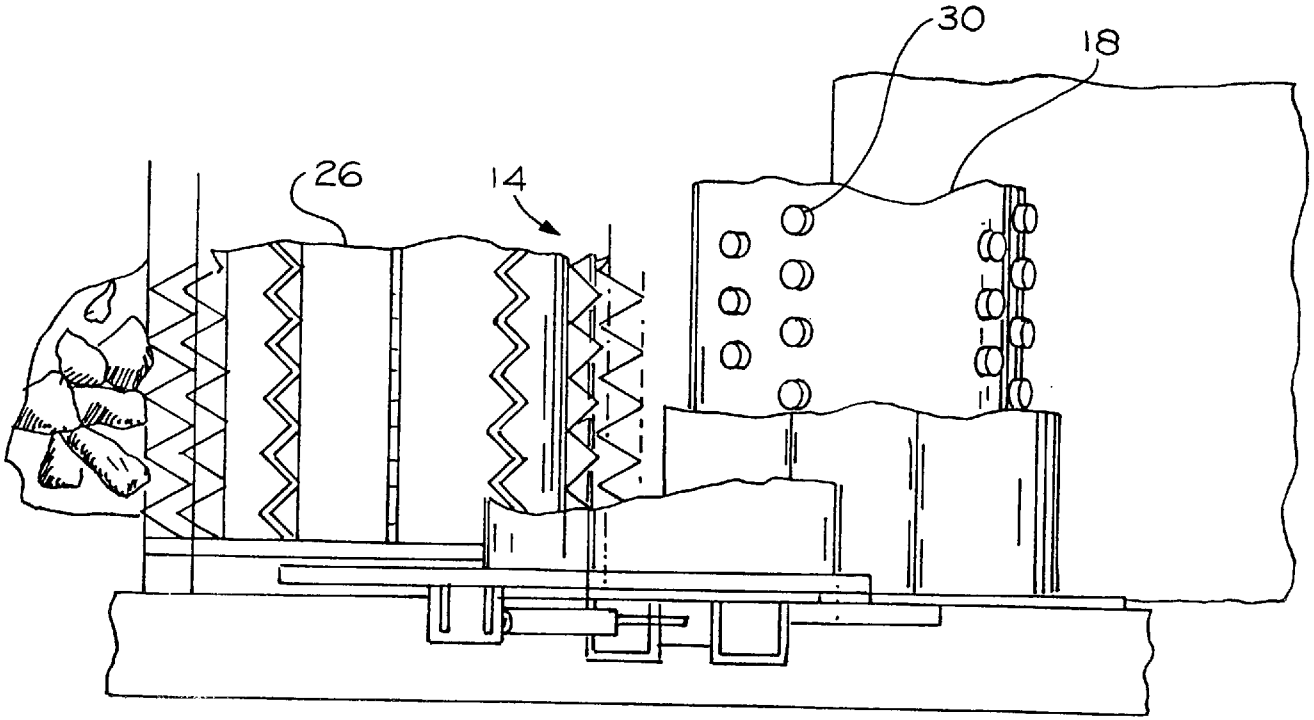
FIG. 4 is a fragmentary top plan view of the grinding mechanism shown in FIG. 3.
Figure 5:
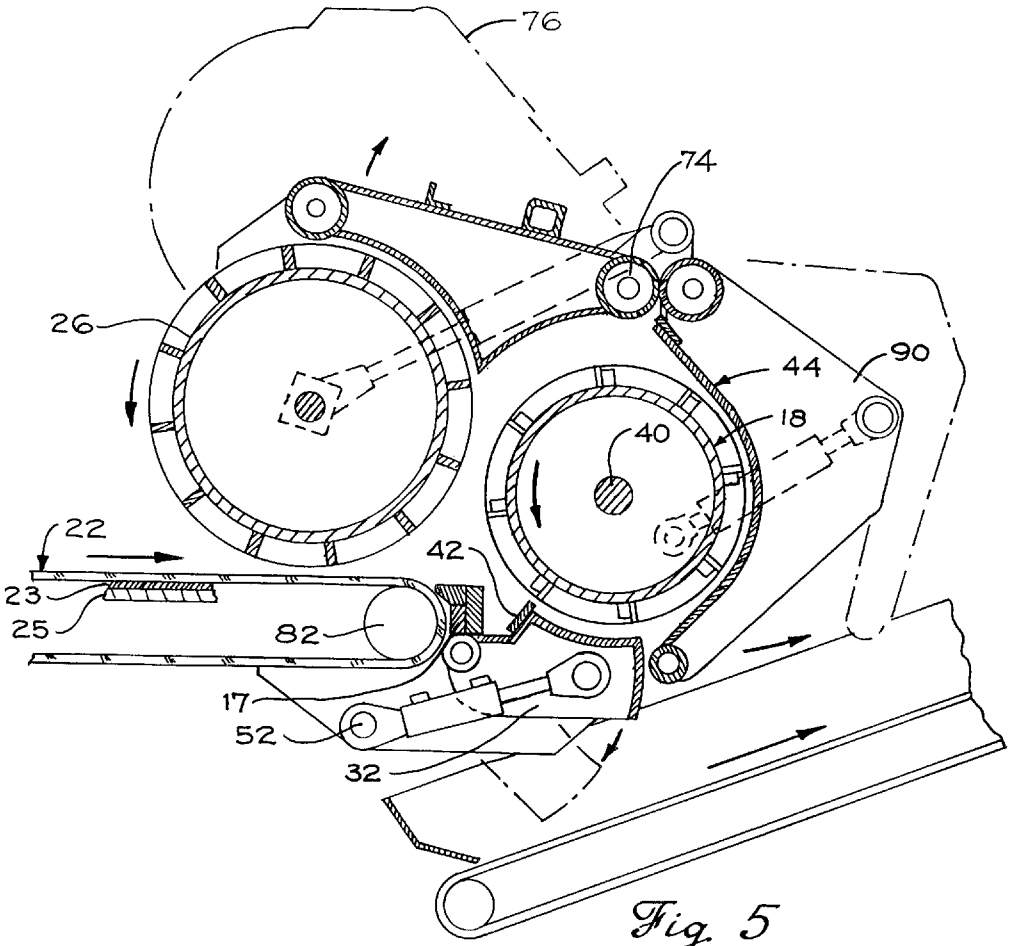
FIG. 5 is a side cross sectional view of an alternative embodiment of a materials grinder embodying various features of the invention.
Figure 6:
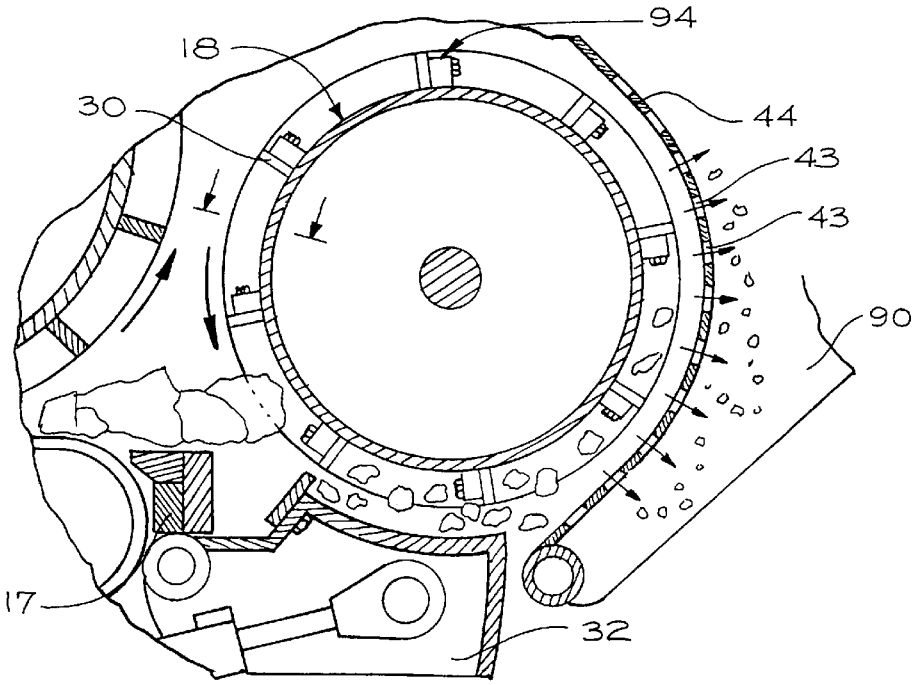
FIG. 6 is a partial side cross sectional view of the materials grinder shown in FIG. 5.
Figure 7:
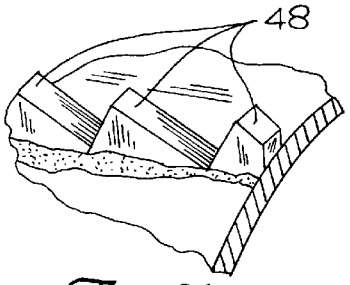
FIG. 7 is a partial perspective view of teeth connected to a feed roller of the materials grinder.
Figure 8:
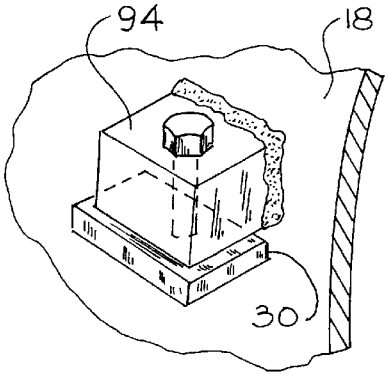
FIG. 8 is a perspective view of a replaceable bit for the grinding drum of the materials grinder.

Referring to the drawings, and in particular, to FIG. 1, a materials grinder 10 embodying various features of the invention is illustrated. The materials grinder 10 comprises an elongate, mobile machine having a hopper 12 at one end for receiving materials to be ground. The hopper 12 is preferably supported on a wheeled frame 13 that also supports a grinding mechanism 14 and an outfeed conveyor 16. The grinding mechanism 14 includes a generally horizontally mounted rotary grinding drum 18 and is preferably of the type shown and described in U.S. Pat. No. 5,344,088 (issued in the name of James H. Page on Sep. 6, 1994 and commonly owned by the assignee hereof) the specification of which is incorporated by reference herein in its entirety.

The hopper 12 is defined in part by two parallel side panels 20 mounted on opposite sides of the frame 13. In accordance with one form of the invention, an infeed conveyor 22 is positioned between the sidewalls 20 and preferably includes a continuous infeed conveyor belt 24. The infeed conveyor belt 24 defines an upper conveying surface that moves laterally toward the grinding drum 18. One end of the infeed conveyor 22 is positioned adjacent the grinding drum 18 to deliver materials conveyed on the conveyor belt 24 to the grinding drum 18. In the illustrated embodiment, an infeed roller 26 is positioned adjacent and somewhat upstream of the grinding drum 18. The infeed roller 26 functions to feed material from the conveyor 22 to the grinding drum 18. The conveyor belt 24 can be formed of rubber or rubberized fabric of known construction and is driven by one or more powered rollers 28. Suitable conveyor belts are available from Scandura Manufacturing Company under the names of U.S. Flex®, and USCOTHANE 440®. Preferably, a commercially available Valueline 220# with 3/16" top coat, bare backing and nylon/nylon reinforced belt is used. Alternatively, the infeed conveyor 22 can be constructed to be impact tolerant as disclosed in the application of Mohrbacker, et al. (filed Feb. 23, 1995 under Ser. No. 08/393,054 now abandoned and commonly owned by the assignee hereof), the specification of which is incorporated by reference herein in its entirety. This impact tolerance is preferably provided by disposing a layer of low friction, substantially rigid material 23 (such as urethane) over a layer of resilient, impact resistant material 25 such as hard rubber. These layers can be placed over a conventional conveyor pan as described in detail in the Mohrbacker, et al. patent application. Alternatively, the Valueline 220# belt can be used directly over a hard rubber material placed on the conveyor pan.

Referring to FIGS. 2–6 and 10, the rotary grinding drum 18 includes an outer circumferential surface having a plurality of abrading bits 30 mounted thereon. The grinding mechanism 14 includes a pivotal structure 32 having an upper end 34 pivotally coupled to a support frame 36 and a lower end 38 that can swing away from the grinding drum 18. The pivotal structure 32 pivots around an axis 40 that is substantially parallel to the rotational axis 52 of the grinding drum. One or more shear bars 42 are located on the pivotal structure 32 adjacent the rotary grinding drum 18 in cooperating relationship therewith. As the grinding drum 18 rotates, material to be ground is crushed and/or ground between the shear bars 42 and the abrading bits 30. The material is further ground and/or crushed between the abrading bits 30 and a sizing screen 44 downstream of the shear bars 42. Apertures 43 of one or more predetermined sizes formed in the sizing screen 44 permit the ground material to fall through the screen onto the outfeed conveyor 16. The infeed roller 26 is mounted between a pair of support arms 46, also pivotally mounted to the support frame 36. The infeed roller 26 preferably includes a plurality of feeder teeth 48 and rotates so that feeder teeth 48 engage the material to be ground and draw the material into contact with the grinding drum 18.

Particularly hard or otherwise ungrindable material may inadvertently be placed in the materials. To avoid jamming or seriously damaging the materials grinder 10 when such material is encountered, a biasing member 50 is provided for permitting limited displacement of the pivotal structure 32 away from the grinding drum 18. This permits the ungrindable material to pass between the grinding drum 18 and the pivotal structure 32. To this end, a hydraulic cylinder 54 is provided between the lower end 38 of the pivotal structure 32 and a fixed anchor point 52 on the frame 13. The hydraulic cylinder 54 is preferably coupled to a hydraulic accumulator 56. The cylinder end of the hydraulic cylinder 54 is preferably connected to the fixed anchor point 52 on the frame 13 and the rod end of the cylinder 54 is connected to the lower end 38 of the pivotal structure 32. Ordinarily, the hydraulic cylinder 54 holds the lower end 38 of the pivotal structure 32 in close proximity to the grinding drum 18. When ungrindable materials are encountered, the force developed by the co-action of the rotating drum 18, the ungrindable material and the shear bars 42 forces the lower end 38 of the pivotal structure 32 away from the grinding drum 18 so as to retract the cylinder 54. This forces hydraulic fluid from the hydraulic cylinder 54 into the accumulator 56, thereby increasing the pressure in the accumulator 56. After the ungrindable materials pass, the increased pressure in the accumulator 56 extends the hydraulic cylinder 54, thereby drawing the lower end 38 of the pivotal structure 32 into the normal operating position adjacent the grinding drum 18.

In another preferred embodiment of the present invention, the infeed conveyor 22 is provided with a conveyor hydraulic drive 21. The infeed roller 26 is also driven hydraulically by a roller drive 27. In conjunction with electrical overload control mechanisms, the infeed conveyor 22 and the infeed roller 26 can be controlled to minimize downtime of the materials grinder 10 due to materials becoming jammed in the rotary grinding drum 18 or the feed mechanism.

Preferably, the infeed conveyor 22 and infeed roller 26 are coupled to a feed overload sensing mechanism 70 (e.g., an adjustable pressure switch) and an engine overload sensing mechanism 72. The feed overload sensing mechanism 70 can comprise one or more conventional pressure switches or their equivalents. If the feed overload sensing mechanism 70 determines that a material jam is occurring at the infeed roller 26 or the infeed conveyor 22, the feed conveyor 22 and the infeed roller 26 are reversed for a predetermined period of time (e.g., 3–10 seconds). This reversal rearranges the material to be ground. After the predetermined period of time has expired, the infeed conveyor 22 and the infeed roller 26 reverse again to the forward direction and continue material grinding. The engine overload sensor 70 can monitor a variety of engine parameters. Preferably, the engine speed is monitored for this purpose. If engine revolutions per minute drop below a predetermined figure, the infeed conveyor 22 and the infeed roller 26 are stopped until engine revolutions per minute return to normal speed.

In this preferred embodiment of the invention, the infeed roller 26 is pivotally mounted at pivot 74. The weight of the infeed roller 26 and its supporting structure generally produces sufficient downforce for effective feeding. The infeed roller 26 uses one or more hydraulic lift cylinders to pivot the infeed roller 26 back to a servicing position 76 shown in phantom in FIG. 5. Optionally, the same hydraulic lift cylinder can be used to apply downward pressure to material fed by the infeed roller 26. This cylinder can be coupled to a conventional accumulator circuit as well, if desired.

The infeed roller 26 and the infeed conveyor 22 preferably have variable speed hydraulic drives 82 for enhanced material feeding. A highly preferred speed configuration sets the infeed roller 26 at a slightly higher speed than the infeed conveyor 22. This enables the infeed roller 26 to remove smaller amounts of material from a large pile on the infeed conveyor 22. In this way, highly resilient material such as small tree branches can be positively fed to the rotary grinding drum 18.

Figure 13:
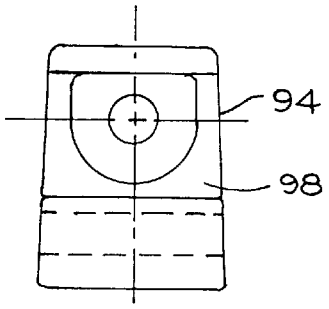
FIG. 13 is a back view of a bit holder for a rotary grinding drum.
Figure 14:
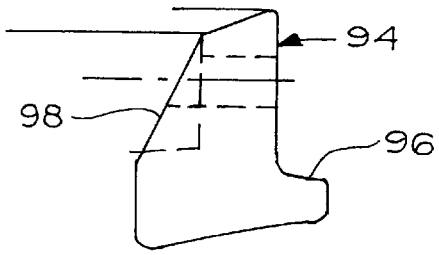
FIG. 14 is a side view of the bit holder shown in FIG. 13.

In accordance with another embodiment of the invention, the rotary grinding drum 18 can include easily customizable patterns of abrading bits 30 and bit holders 94. The bits 30 can be rotated to expose new cutting edges and are replaceable with the same types of bits or a variety of other specialized bits. The bit holders 94 can take a variety of forms, but preferably countersunk and relieved forged steel units are used as shown in FIGS. 13 and 14. The bit holder 94 includes a ledge 96 upon which a bit 30 is supported. The bit 30 can be conventionally bolted to the bit holder 94. The back 98 of the bit holder 94 is relieved and countersunk to prevent the bolt and the back 98 from contacting material to be ground.

Figure 9:
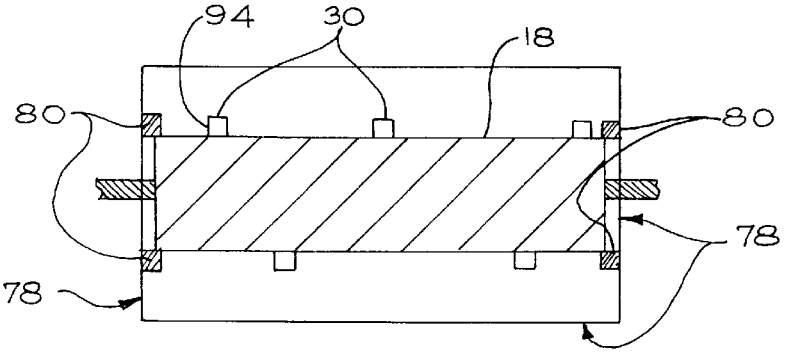
FIG. 9 is a cross sectional view of the rotary grinding drum and a seal structure used in one embodiment of the invention.
Figure 10:
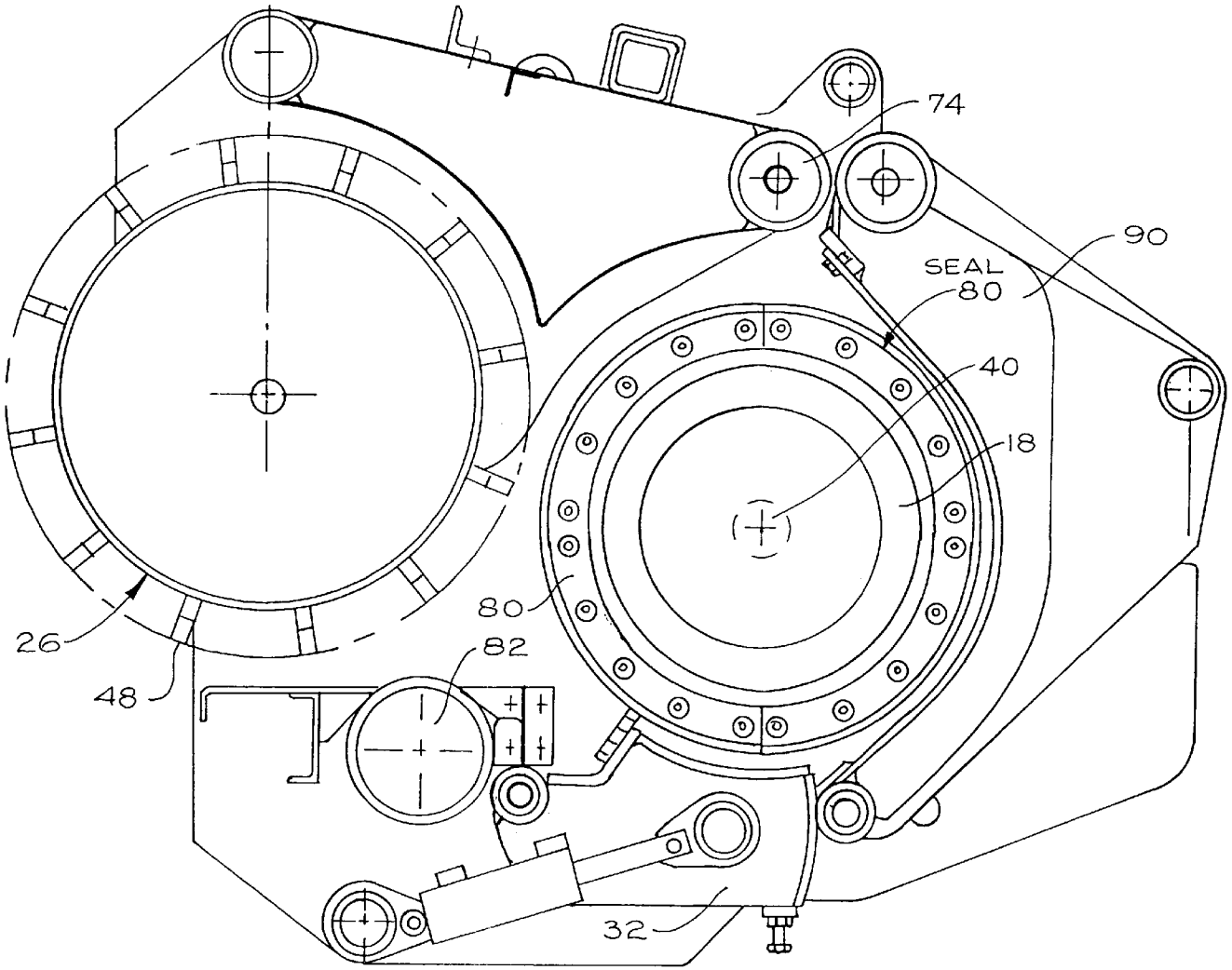
FIG. 10 is a side cross sectional view of a materials grinder including a labyrinth sealing structure.

It has been discovered that the components of the materials grinder 10 located at the ends of the rotary grinding drum 18 can become worn, or material can be lodged in a gap between the rotary grinding drum 18 and an adjacent housing 78. A highly preferred embodiment of the present invention includes a labyrinth seal structure 80 bolted to the housing 78 as shown in FIGS. 9 and 10. The labyrinth seal structure 80 is disposed adjacent the ends of the rotary grinding drum 18. One labyrinth seal structure 80 is located at each end of the rotary grinding drum 18, and is dimensioned to completely fill any gaps between the housing and the rotary grinding drum 18. The labyrinth seal structure 80 preferably extends radially away from the surface of the rotary grinding drum 18 to a level close to that of the outer tips of the bits 30. The labyrinth seal structure 80 can comprise a variety of materials, although preferably T1 abrasion-resistant steel or similar material is used. Each labyrinth seal structure 80 can be separated into two or more sections to facilitate replacement.

A rigidly mounted, replaceable anvil 17 can be mounted adjacent the infeed conveyor 22 and the rotary grinding drum 18. In this embodiment, the anvil 17 performs crushing and grinding action cooperating with the rotary grinding drum 18. This enables the shear bar 42 to further process the material before it travels to the sizing screen 44. The shear bar 42 preferably comprises T1-grade abrasion resistant material and is preferably reversible, replaceable and positioned perpendicular to the cutting circle defined by the ends of the bits 30 such that the shear bar 42 is self-sharpening. While a variety of shapes and support configurations can be used to support the shear bar 42, preferably a pivotal structure 32 is used. The pivotal structure 32 is preferably connected to a hydraulic accumulator as described in previous embodiments of the invention. The pressure settings for the accumulator can be substantially decreased, however, due to the anvil 17 performing the first crushing and grinding function.

Figure 11:
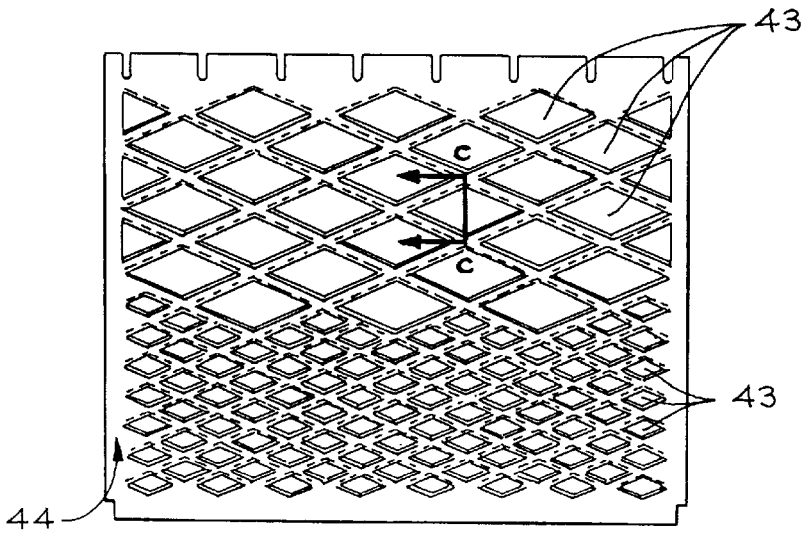
FIG. 11 is a top plan view of a graduated sizing screen.
Figure 12:
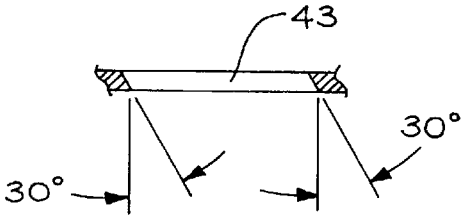
FIG. 12 is a cross sectional view taken along line c—c of FIG. 10.

The sizing screen 44 can include a variety of sizes and shapes of apertures 43. The sizing screen 44 can also have graduated sizes of apertures 43 for increased output flow as shown in FIGS. 11 and 12.

Further processing improvements may be provided by tapering one or more surfaces of the apertures 43. For example, inside edges of the apertures 43 can be tapered as shown in FIG. 12 for improved material flow and improved shearing action.

An upper concave 90 holds one or more sizing screens 44, is hinged and pivots open to assist in clearing material jams. It is held in operating position with two hydraulic cylinders. The cylinders will also open the concave beyond the normal operating opening to allow reading changing of the sizing screen 44.

The upper concave 90 preferably holds the sizing screen 44 such that a pinch point is created as the material travels around the back side of the rotary grinding drum 18 as shown in FIG. 10. This pinch point improves chip size, increases material flow and produces more uniform wear on the screen.

As ground material exits the upper concave 90 through the sizing screen 44, it drops into a discharge hopper 12 and onto a conventional slider bed type of conveyor. The conveyor is covered to contain ground material so spillage and airborne dust is minimized.

The materials grinder 10 herein described is well suited to grinding a variety of materials. The infeed conveyor 22 is well suited to transporting relatively light, springy material such as a brush, live branches and other green waste that would ordinarily spring upwardly away from the grinding drum 18 if a ram were used to push the materials toward the grinding drum. In the illustrated embodiment, green waste materials are conveyed by the infeed conveyor 22 horizontally toward the grinding mechanism 14 where they are engaged by the infeed roller 26. The infeed roller 26, in combination with the infeed conveyor 22, functions to pull, rather than push, the green waste materials into the grinding drum 14. The positive engagement of the infeed roller 26 with the materials thus feeds the materials into the grinding drum 18 more effectively than would a ram or pusher. Although effective in grinding green waste, the materials grinder 10 remains well suited for grinding heavier materials such as railroad ties and various building materials. The impact tolerant infeed conveyor 22 is well suited to receiving such materials, and the pivotal structure 32 permits ungrindable materials to pass through the machine 10 without jamming, thereby minimizing damage to the machine. The materials grinder 10 herein shown and described is, therefore, well suited to grinding a variety of materials ranging from relatively light, springy materials at one end to large, heavy rigid materials at the other.

While a particular embodiment of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

We claim:

1. A materials grinder comprising:

a rotary grinding drum;

a housing disposed adjacent said rotary grinding drum;

sealing structures disposed adjacent ends of said rotary grinding drum for preventing materials from lodging at said ends;

an anvil mounted adjacent said rotary grinding drum;

a pivotal structure adjacent said rotary grinding drum;

a shear bar on said pivotal structure adjacent said rotary grinding drum and in cooperating relationship therewith;

a displaceable biasing member for biasing said pivotal structure toward said rotary grinding drum;

said biasing member permitting limited displacement of said pivotal structure away from said rotary grinding drum to permit ungrindable materials to pass between said rotary grinding drum and said pivotal structure, the pivotal structure being displaced automatically by the ungrindable material being moved between the shear bar and the rotary grinding drum;

an infeed conveyor having an upper conveying surface and an end adjacent said rotary grinding drum for receiving materials to be ground on said upper conveying surface and for conveying said materials to said rotary grinding drum; and an infeed roller pivotally mounted over said infeed conveyor and cooperating with said rotary grinding drum.

2. A materials grinder as defined in claim 1 wherein said displaceable biasing member includes a hydraulic cylinder coupled to a hydraulic accumulator.

3. A materials grinder as defined in claim 1 wherein said sealing structures extend radially from a circumference of said rotary grinding drum to a cutting circle substantially defined by bits connected to said rotary grinding drum.

4. A materials grinder as defined in claim 1 wherein said sealing structures are connected to a housing disposed adjacent said rotary materials grinder, thereby reducing wear of said housing due to material rotating by said housing.

5. A materials grinder as defined in claim 1 wherein said infeed roller and said infeed conveyor are driven at different speeds to enhance material feeding.

6. A materials grinder as defined in claim 1 wherein said infeed conveyor includes a continuous belt defining said upper conveying surface traveling over at least one stationary, substantially resilient material layer.

7. A materials grinder as defined in claim 6 wherein said infeed conveyor and said infeed roller are automatically reversible when a jam of materials to be ground occurs.

8. A materials grinder comprising:

a rotary grinding drum;

a housing disposed adjacent said rotary grinding drum;

sealing structures disposed adjacent ends of said rotary grinding drum for preventing materials from lodging at said ends;

an anvil mounted adjacent said rotary grinding drum;

a pivotal structure adjacent said rotary grinding drum;

a shear bar on said pivotal structure adjacent said rotary grinding drum and in cooperating relationship therewith;

a displaceable biasing member for biasing said pivotal structure toward said rotary grinding drum;

said biasing member permitting limited displacement of said pivotal structure away from said rotary grinding drum to permit ungrindable materials to pass between said rotary grinding drum and said pivotal structure, the pivotal structure being displaced automatically by the ungrindable material being moved between the shear bar and the rotary grinding drum;

a displaceable support for supporting said pivotal structure so as to permit said pivotal structure to move away from said grinding drum when ungrindable said materials are encountered to permit passage of the ungrindable materials through said materials grinder without damaging or jamming said materials grinder;

an infeed conveyor having an upper conveying surface and an end adjacent said rotary grinding drum for receiving materials to be ground on said upper conveying surface and for conveying said materials to said rotary grinding drum; and an infeed roller pivotally mounted over said infeed conveyor and cooperating with said rotary grinding drum.

9. A materials grinder as defined in claim 8 wherein said displaceable support includes a hydraulic cylinder coupled to a hydraulic accumulator.

10. A materials grinder as defined in claim 8 wherein said materials grinder further includes an anvil adjacent said rotary grinding drum.

11. A materials grinder as defined in claim 8 wherein said infeed roller is pivotally mounted and disposed such that circumferential portions of said infeed roller and said rotary grinding drum are located a distance away from rotary grinding drum that is less than an outer radius of said infeed roller away from one another.

12. A materials grinder as defined in claim 8 wherein said infeed conveyor includes a continuous belt defining an upper conveying surface running over at least one substantially rigid material layer and at least one substantially resilient layer.

13. A materials grinder as defined in claim 12 wherein said infeed conveyor is driven slower than said infeed roller.

14. A materials grinder comprising:

a rotary grinding drum having a surface including a plurality of abrading bits mounted thereon;

an anvil adjacent said rotary grinding drum;

a pivotal structure adjacent said rotary grinding drum mounted for rotation around an axis parallel to the axis of said grinding drum;

a shear bar on said pivotal structure in cooperating relationship with said abrading bits;

a displaceable support urging said pivotal structure toward said grinding drum and being displaceable to allow said pivotal structure to pivot away from said rotary grinding drum when ungrindable material is encountered to allow the ungrindable material to pass between said shear bar and said rotary grinding drum, the pivotal structure being displaced automatically by the ungrindable material being moved between the shear bar and the rotary grinding drum;

an infeed conveyor having a belt for transporting material toward said rotary grinding drum, said infeed conveyor being driven by a first variable speed drive responsive to at least one overload sensor for sensing overloading of said rotary grinding drum; and an infeed roller adjacent said infeed conveyor and said grinding drum for feeding the material from said infeed conveyor to said grinding drum, said infeed roller being driven by a second variable speed drive responsive to at least one overload sensor.

15. A materials grinder as defined in claim 14 wherein said displaceable support includes a hydraulic cylinder coupled to a hydraulic accumulator.

16. A materials grinder as defined in claim 14 wherein said first drive and said second drive are reversible in response to an overload condition.

17. A materials grinder as defined in claim 14 wherein said infeed conveyor includes a continuous belt defining an upper conveying surface running over at least one substantially rigid material layer and at least one substantially resilient layer.

18. A materials grinder comprising:

a rotary grinding drum having a surface including a plurality of abrading bits mounted thereon;

an anvil rigidly mounted adjacent said rotary grinding drum;

a pivotal concave structure adjacent said rotary grinding drum mounted for rotation around an axis parallel to the axis of said rotary grinding drum;

a shear bar on said pivotal concave structure in cooperating relationship with said abrading bits;

a displaceable support urging said pivotal concave structure toward said rotary grinding drum and being displaceable to allow said pivotal structure to pivot away from said rotary grinding drum when ungrindable material is encountered to allow the ungrindable material to pass between said shear bar and said rotary grinding drum, the pivotal structure being displaced automatically by the ungrindable material being moved between the shear bar and the rotary grinding drum;

an infeed conveyor having a belt for transporting material toward said rotary grinding drum, and said infeed conveyor being driven by a first variable speed drive responsive to at least one overload sensor for sensing overloading of said rotary grinding drum; and an infeed roller adjacent said infeed conveyor and said grinding drum for feeding the material from said infeed conveyor to said grinding drum, said infeed roller being driven by a second variable speed drive responsive to at least one overload sensor.

19. A materials grinder as defined in claim 18, wherein said infeed conveyor is driven faster than the speed of a circumferential portion of said infeed roller.

* * * * *